US006147460A

United States Patent [19]

Ichihara

[11] Patent Number: 6,147,460

[45] **Date of Patent: *Nov. 14, 2000**

[54] FLASH APPARATUS

[75] Inventor: Yoshiro Ichihara, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/318,005

[22] Filed: May 25, 1999

[30] Foreign Application Priority Data

Jun. 4, 1998 [JP] Japan ..... 10--155860

[51] Int. Cl.[7] ..... H05B 37/00

[52] U.S. Cl. ..... 315/241 P; 396/205; 315/219

[58] Field of Search ..... 315/241 P, 219, 315/291, 227 R; 396/205, 206

[56] References Cited

U.S. PATENT DOCUMENTS 4,251,753 2/1981 Kondo ..... 315/219

*Primary Examiner*—David Vu

*Attorney, Agent, or Firm*—Robin, Blecker & Daley

[57] ABSTRACT

In a power supply device for a flash apparatus having the primary winding side of a transformer and an oscillation-controlling switching element connected in parallel to a power supply and the secondary winding side of the transformer connected to a main capacitor through a rectifier element, a current-to-voltage conversion circuit is arranged to output a voltage signal according to a current flowing from the secondary winding side of the transformer to the main capacitor, and the main capacitor is charged by on-off controlling the switching element according to the voltage signal outputted from the current-to-voltage conversion circuit.

24 Claims, 6 Drawing Sheets

FLASH APPARATUS

BACKGROUND OF THE INVENTION

1. Field of the Invention

The present invention relates to a power supply device which charges a main capacitor for use in a flash apparatus or the like.

2. Description of Related Art

In the field of cameras having electronic flash apparatuses, it has become necessary to reduce the sizes of component parts of flash apparatuses as the sizes of cameras have become smaller. Batteries used as power sources for the flash apparatuses also have come to be in a smaller size to have a lower voltage. As a result, it has become necessary to use a step-up circuit (a power supply device or a converter) which is made compact and arranged to stably oscillate.

To meet this requirement, for example, a step-up circuit disclosed in Japanese Laid-Open Patent Application No. SHO 54-102521 is arranged as shown in FIG. 6. Referring to FIG. 6, a protective resistor 102 is connected to a power supply 101. A switch 103 is connected in series to the protective resistor 102. A primary coil 104*a* and a feedback coil 104*b* of an oscillation transformer 104 are connected to the protective resistor 102 and the switch 103. The primary coil 104*a* is connected to the collector of an oscillation transistor 105, which is composed of a silicon transistor. The feedback coil 104*b* is connected to the base of the oscillation transistor 105.

An oscillation capacitor 106 is connected to the base circuit of the oscillation transistor 105 in parallel therewith. To a secondary coil 104*c* of the oscillation transformer 104 are connected a capacitor 107, a protective resistor 108 and a diode 110. A neon tube 109 is connected to the protective resistor 108.

A main capacitor 111 is connected to the diode 110. In addition, there are provided output terminals 112*a* and 112*b*.

With the step-up circuit arranged in the above manner, the electric charge of the power supply 101 is supplied to the oscillation transformer 104 when the switch 103 is turned on. Then, a current flows to the base of the oscillation transistor 105, which is connected to the oscillation transformer 104. Thus, an oscillation circuit is formed by the flow of current to begin oscillation.

The switch 103 is arranged either to immediately turn off upon completion of its turn-on action or to turn off after the lapse of, for example, three seconds.

The oscillation circuit operates to continue oscillation, because energy stored in the inductance of the oscillation transformer 104 is electromagnetically induced to the feedback coil 104*b* and the secondary coil 104*c* for dissipating the energy and a current necessary for the oscillation is allowed to flow to the base circuit as the input resistance and oscillation frequency of the oscillation transistor 105 are high.

The signal which has been supplied to the oscillation transformer 104 and has been boosted there in the above manner is supplied to a load part which includes the main capacitor 111. The capacitor 107, which is connected to the load part, corrects the waveform of the signal by absorbing a surge voltage.

Since the thus-corrected signal is supplied to the neon tube 109 through the protective resistor 108, the on-state of the oscillation circuit can be verified by a lighted-up state of the neon tube 109 and the off-state of the oscillation circuit can be verified by a put-out state of the neon tube 109.

Further, the above signal is rectified by the diode 110 and is, then, stored in the main capacitor 111. The signal stored in the main capacitor 111 is supplied from the output terminals 112*a* and 112*b*, for example, to a discharge circuit of a flash apparatus.

The oscillation circuit is arranged to automatically turn off in the following manner. Before the main capacitor 111, which is a load, is charged, a current of, for example, 50 mA is caused to flow to the main capacitor 111. The current comes to decrease accordingly as the main capacitor 111 is gradually charged with electric charge. When the current decreases to a value of, for example, 50 $\mu$A, the base current of the base circuit also decreases accordingly. Then, the oscillation transistor 105 comes to have only a current of less than its operating point flowing there. As a result, the oscillating function of the oscillation transistor 105 comes to a stop, so that the supply of power is cut off.

In the conventional step-up circuit described above, the oscillation transistor 105 is connected in series to the primary winding (primary coil 104*a*) of the oscillation transformer 104. The base current of the oscillation transistor 105 is controlled by the charging current flowing to the main capacitor 111. The step-up circuit is thus arranged to have a current feedback system. Further, to make the start-up of the oscillation transistor 105 reliable, the feedback winding (feedback coil 104*b*) of the oscillation transformer 104 is also used.

However, in order to charge the main capacitor 111 up to a necessary voltage level, the arrangement for using the oscillation transistor 105 for controlling the oscillation of the oscillation transformer 104 has necessitated selecting and setting, as the oscillation transistor 105, such a transistor that has a large current-amplification factor proportional to the transformer winding and has a low emitter-to-collector voltage during oscillation.

Another problem with the conventional step-up circuit also lies in that, depending on the setting of arrangement of the oscillation transistor 105, the size of the transistor element becomes large.

Further, a transistor has such an element that the current-amplification factor thereof varies with temperature. For example, at a low temperature, the current-amplification factor of the oscillation transistor becomes smaller and the oscillation comes to a stop before the charging voltage reaches a setting voltage value.

Further, when the load of the main capacitor becomes lighter in the last stage of a charging process, the charging current becomes smaller in proportion to the decrease of the load. Then, the base current of the oscillation transistor also becomes smaller to make the oscillation difficult. Therefore, in order to ensure a stable operation, the oscillation must be caused to be carried on by using the feedback winding. Otherwise, it is hardly possible to have a stable operation and to have the charging voltage reach the setting voltage value.

BRIEF SUMMARY OF THE INVENTION

It is an object of the invention to provide a self-excited power supply device which is arranged to be capable of stably operating, even at a low temperature and in the event of a light load, by using a compact switching element, such as a field-effect transistor (FET), and also to provide a flash apparatus having the self-excited power supply device.

To attain the above object, in accordance with an aspect of the invention, there is provided a power supply device (for a flash apparatus), which comprises a transformer for stepping up a voltage of a power supply, an oscillation-controlling switching element, a first winding of the transformer and the switching element being connected in parallel with the power supply, and current-to-voltage conversion means for outputting a voltage signal according to a current flowing from a secondary winding of the transformer to a main capacitor, wherein turning-on and turning-off of the switching element are controlled in accordance with the voltage signal outputted from the current-to-voltage conversion means so as to effect an oscillation operation.

In accordance with another aspect of the invention, there is provided a DC-to-DC converter device for a flash apparatus, or a flash apparatus having the DC-to-DC converter device, which comprises a transformer, a switching element connected in series to a primary coil of the transformer, the switching element being turned on to cause a current from a power supply to flow to the primary coil and being turned off to cut off the current to the primary coil, current-to-voltage conversion means connected to a secondary coil of the transformer for forming a voltage according to a value of a current flowing to the secondary coil, and a signal forming circuit which detects the voltage formed by the current-to-voltage conversion means and shifts an output state thereof from a first signal output state to a second signal output state when having detected that the voltage indicates a voltage value representing that the value of the current flowing to the secondary coil is not less than a predetermined value, wherein the switching element is connected to the signal forming circuit and is arranged to be turned on when the output state of the signal forming circuit is the first signal output state and to be turned off when the output state of the signal forming circuit is the second signal output state.

In accordance with a further aspect of the invention, there is provided a DC-to-DC converter device for a flash apparatus, or a flash apparatus having the DC-to-DC converter device, which comprises a transformer, a switching element connected in series to a primary coil of the transformer, the switching element being turned on to cause a current from a power supply to flow to the primary coil and being turned off to cut off the current to the primary coil, a current-to-voltage conversion circuit having a transistor and an impedance element, a base of the transistor being connected to a secondary coil of the transformer so that a base current according to a value of a current flowing to the secondary coil flows, a collector of the transistor being connected to the impedance element, the transistor forming, as an output of the impedance element, a voltage according to the value of the current flowing to the secondary coil, and a signal forming circuit which detects the voltage formed by the current-to-voltage conversion circuit and shifts an output state thereof from a first signal output state to a second signal output state when having detected that the voltage indicates a voltage value representing that the value of the current flowing to the secondary coil is not less than a predetermined value, wherein the switching element is connected to the signal forming circuit and is arranged to be turned on when the output state of the signal forming circuit is the first signal output state and to be turned off when the output state of the signal forming circuit is the second signal output state.

The above and other objects and features of the invention will become apparent from the following detailed description of preferred embodiments thereof taken in connection with the accompanying drawings.

DETAILED DESCRIPTION OF THE INVENTION

Hereinafter, preferred embodiments of the invention will be described in detail with reference to the drawings.

(First Embodiment)

Figure 1:
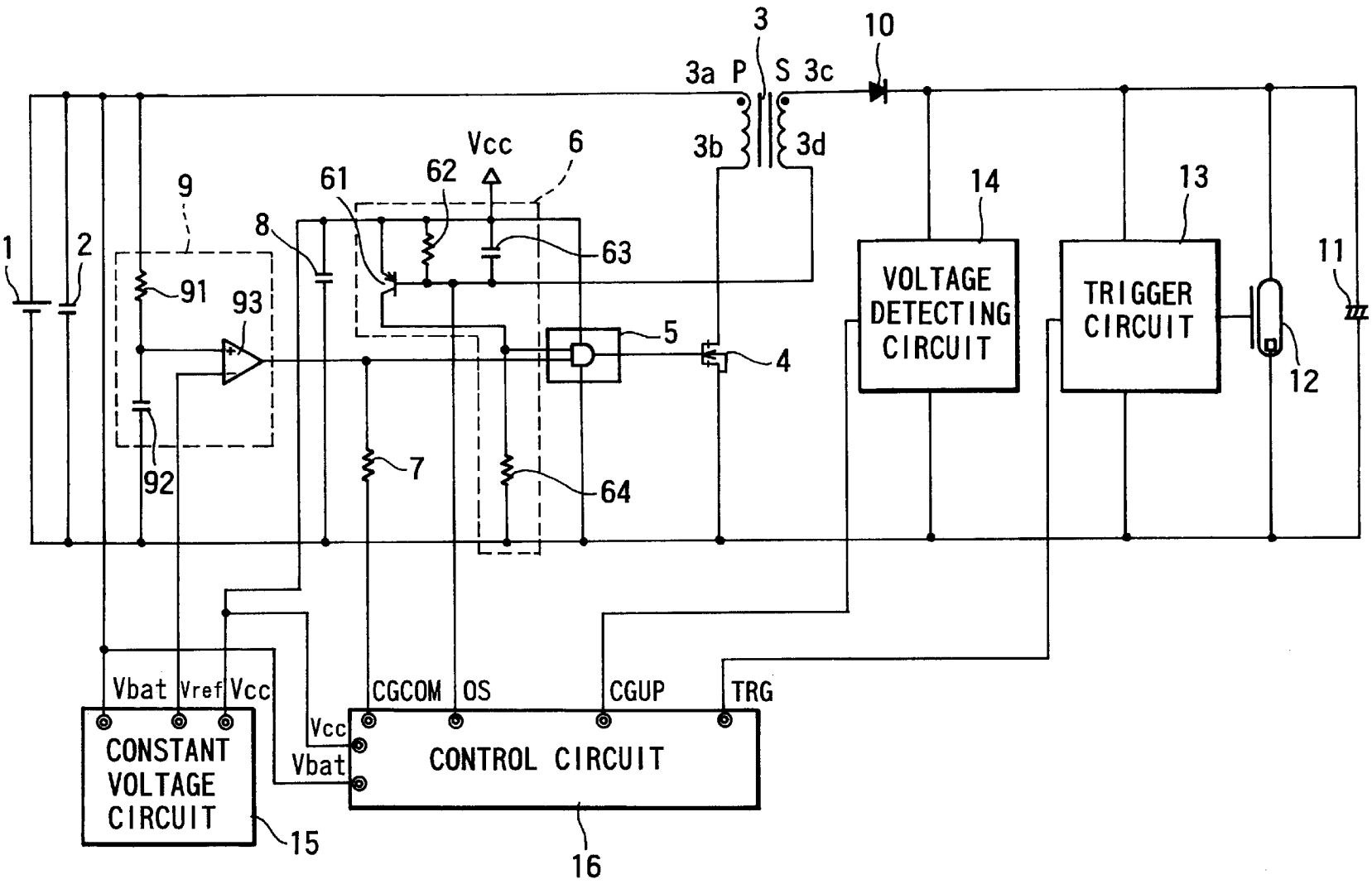
FIG. 1 is a circuit block diagram of a flash apparatus according to a first embodiment of the invention.

FIG. 1 shows the circuit arrangement of a flash apparatus provided with a self-excited step-up circuit (power supply device) according to a first embodiment of the invention. The flash apparatus is incorporated in a camera or is externally disposed on the camera.

Referring to FIG. 1, a battery 1 is used for a power supply. A capacitor 2 for stabilizing the power supply is connected to both ends of the battery 1. A transformer 3 is arranged to step up the voltage of the battery 1. To one terminal 3*a* of the primary winding of the transformer 3 is connected the positive electrode of the power supply battery 1. To the other terminal 3*b* of the primary winding of the transformer 3 is connected the drain of an N-channel field-effect transistor (hereinafter referred to as the FET) 4, which serves as a switching element. To one terminal 3*c* of the secondary winding of the transformer 3 is connected the anode of a rectifier diode 10. To the other terminal 3*d* of the secondary winding of the transformer 3 is connected the base of a PNP transistor 61.

To the drain of the FET 4 is connected the terminal 3*b* of the primary winding of the transformer 3. To the source of the FET 4 is connected the negative electrode of the battery 1. To the gate of the FET 4 is connected the output of a CMOS (complementary metal oxide semiconductor) logic circuit 5, which serves as an active element.

In the case of the first embodiment, the logic circuit 5 is composed of AND logic. The logic circuit 5 is an ordinary IC which uses an output Vcc of a constant voltage circuit 15 as a power supply. The output of the logic circuit 5 depends on the power supply voltage. The logic circuit 5 is further arranged to be a driver circuit for driving the gate of the FET 4, to stabilize the gate voltage and to improve the rise and fall characteristics of on-off time control.

One of the inputs to the logic circuit 5 is the output of a current-to-voltage conversion circuit 6, and the other of the inputs to the logic circuit 5 is a signal from a terminal CGCOM of a control circuit 16 (hereinafter referred to as the signal CGCOM). The output of the logic circuit 5 is connected to the gate of the FET 4.

The logic circuit 5 outputs a high level (hereinafter abbreviated to "HL") signal only when both the output of the current-to-voltage conversion circuit 6 and the signal CGCOM are at "HL", and outputs a low level (hereinafter abbreviated to "LL") signal when the signal CGCOM is at "LL".

The current-to-voltage conversion circuit 6 is arranged to convert a current flowing from the secondary winding of the transformer 3 to a main capacitor 11 into a driving voltage for the switching element, and is composed of elements 61 to 64 to be described below.

The element 61 is a PNP transistor which has an emitter connected to the output Vcc of the constant voltage circuit 15 and a base connected to the terminal 3*d* of the secondary winding of the transformer 3.

The element 62 is a protective resistor which is connected between the emitter and base of the PNP transistor 61. The element 63 is a protective capacitor which is connected between the emitter and base of the PNP transistor 61.

The element 64 is a resistor which has one end thereof connected to the collector of the PNP transistor 61 and the other end thereof connected to the negative electrode of the battery 1.

With the current-to-voltage conversion circuit 6 arranged in the above manner, when a base current of the PNP transistor 61 is pulled during oscillation, a current which is proportional to the base current flows between the emitter and collector of the PNP transistor 61 to bring about an electromotive force at the resistor 64, so that the current is converted into a voltage. According to the prior art arrangement, a charging current flowing to the main capacitor directly becomes a base current of the oscillation transistor, whereas the first embodiment of the invention includes the current-to-voltage conversion circuit 6 arranged in the above manner.

A resistor 7 has one end thereof connected to the terminal CGCOM of the control circuit 16 and the other end thereof connected to the input of the logic circuit 5.

A capacitor 8 is connected between the output Vcc of the constant voltage circuit 15 and the negative electrode of the battery 1 for stabilization of the operation of the step-up circuit.

An output voltage maintaining circuit 9 is arranged to maintain the output voltage (voltage Vcc) of the constant voltage circuit 15 when the battery voltage drops during a charging process. The constant voltage circuit 15 becomes incapable of maintaining its output voltage when its input voltage (from the battery) suddenly drops like in the case of charging. Therefore, the output voltage maintaining circuit 9 is arranged to cut off the control signal CGCOM when the input voltage becomes lower than a power-supply-voltage cut-off level (voltage Vref) set by the constant voltage circuit 15.

A resistor 91 has one end thereof connected to the positive electrode of the battery 1 and the other end thereof connected to the non-inverting input terminal of a comparator 93.

A capacitor 92 has one end thereof connected to the non-inverting input terminal of the comparator 93 and the other end thereof connected to the negative electrode of the battery 1. The capacitor 92 is arranged to have hysteresis with respect to its input.

The comparator 93 is arranged, in this case, to have an open-collector-type output. To the non-inverting input terminal of the comparator 93 is connected the other end of the resistor 91 and one end of the capacitor 92. To the inverting input terminal of the comparator 93 is supplied the power-supply-voltage cut-off level voltage Vref from the constant voltage circuit 15. Further, the output of the comparator 93 is connected to one end of the resistor 7 and the input of the logic circuit 5.

The anode of the high-voltage rectifier diode 10 is connected to the terminal 3*c* of the secondary winding of the oscillation transformer 3, and the cathode of the high-voltage rectifier diode 10 is connected to a voltage detecting circuit 14, a trigger circuit 13, the positive electrode of the main capacitor 11 and the positive electrode of a flash discharge tube 12.

The main capacitor 11 is arranged to be charged with energy which is necessary for flash light emission. The positive electrode of the main capacitor 11 is connected to the cathode of the high-voltage rectifier diode 10, and the negative electrode of the main capacitor 11 is connected to the negative electrode of the battery 1.

The positive electrode of the flash discharge tube 12 is connected to the positive electrode of the main capacitor 11, and the negative electrode of the flash discharge tube 12 is connected to the negative electrode of the battery 1.

The trigger circuit 13 is arranged to cause the flash discharge tube 12 to emit flash light and is connected to the both ends of the main capacitor 11, to the trigger band of the flash discharge tube 12, etc. The trigger circuit 13 performs its trigger action in response to a signal TRG received from the control circuit 16.

The voltage detecting circuit 14 is arranged to detect a voltage at the both ends of the main capacitor 11 and is connected to the both ends of the main capacitor 11. More specifically, the voltage detecting circuit 14 is arranged to send a resistor-divided voltage value as a signal CGUP to the control circuit 16.

The constant voltage circuit 15 is arranged to output a constant voltage (voltage Vcc) which remains unvarying even when the voltage of the battery 1 varies. The output terminal Vcc of the constant voltage circuit 15 is connected to the emitter of the PNP transistor 61, the logic circuit 5 and the control circuit 16. The output terminal Vref of the constant voltage circuit 15 is connected to the inverting input terminal of the comparator 93.

The control circuit 16 is composed of a one-chip microcomputer in the case of the first embodiment and includes a CPU, a ROM, a RAM, an input/output (I/O) control circuit, a multiplexer, a timer circuit, etc. The control circuit 16 performs system control over the flash apparatus according to a predetermined program. The output Vcc of the constant voltage circuit 15 is connected to the control circuit 16 as a power source. In addition to that, the output of the power supply 1 is also connected to the control circuit 16. Further, the control circuit 16 is arranged to output from a terminal OS a one-shot pulse signal which changes from an "OPEN" state to an "LL" state for a predetermined short period of time.

Next, the actions of the flash apparatus (the control circuit 16 in particular) described above and those of a camera having the flash apparatus are described with reference to a flow chart shown in FIG. 2. The constant voltage circuit 15 is first activated when a power supply switch (not shown) is turned on. The constant voltage Vcc is then generated at the constant voltage circuit 15. The constant voltage Vcc is supplied to the control circuit 16 and each of other circuit blocks. With power supplied to the control circuit 16, the CPU within the microcomputer is reset. Further, the power-supply-voltage cut-off level (voltage Vref) is set by the constant voltage circuit 15 and is supplied to the inverting input terminal of the comparator 93. At this time, the voltage of the battery 1 is being supplied through the resistor 91 to the non-inverting input terminal of the comparator 93. Thus, the voltage of the battery 1 is being detected.

Figure 2:
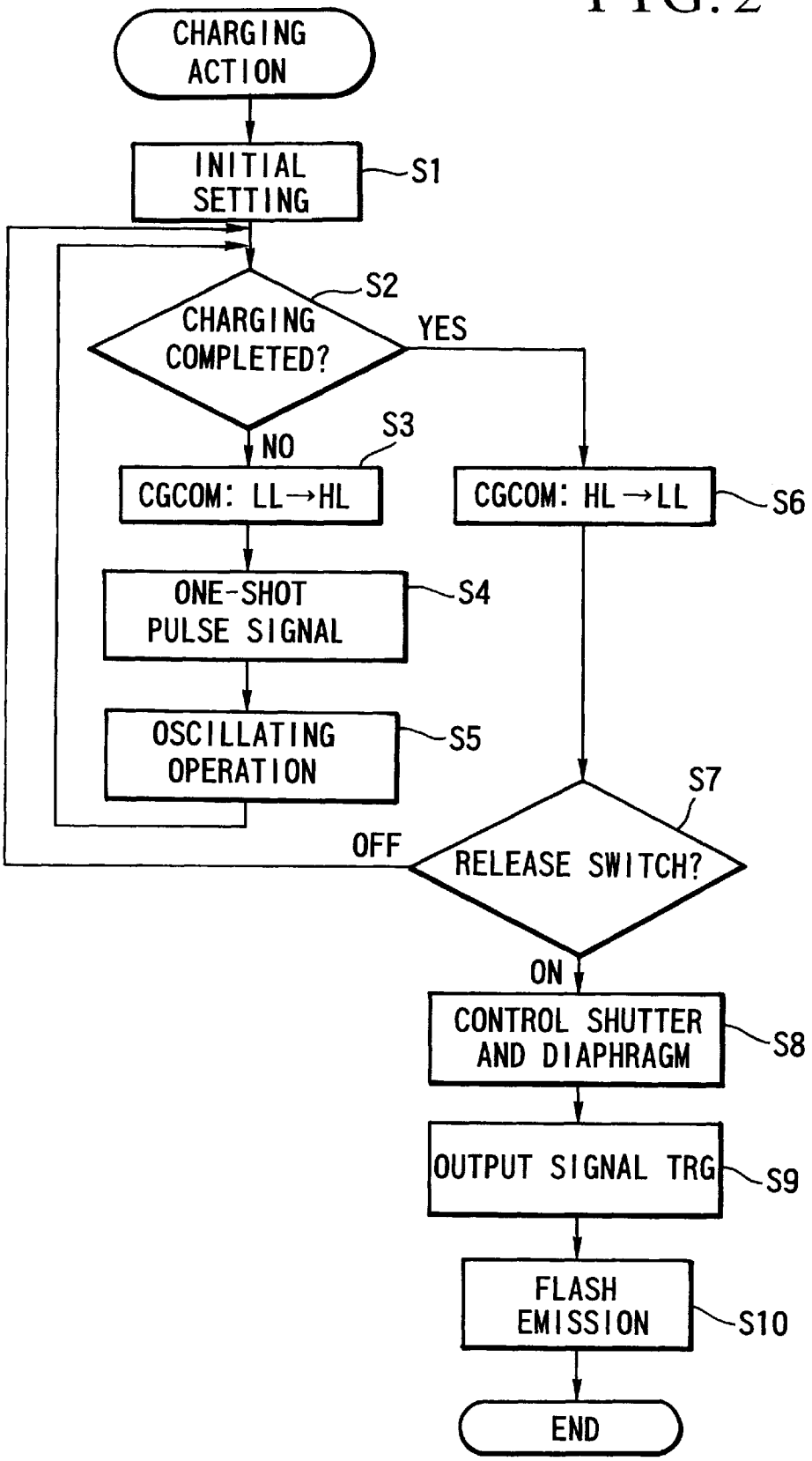
FIG. 2 is a flow chart showing an operation of the flash apparatus shown in FIG. 1.

Referring to FIG. 2, at a step S1, an initial setting action is performed. For example, the flags of the program are cleared and the contents of memories are reset.

At a step S2, the voltage of the main capacitor 11 is detected by the voltage detecting circuit 14. More specifically, the voltage of the main capacitor 11 is divided by the resistor, and a divided voltage thus obtained is inputted to the control circuit 16 through the input signal terminal CGUP.

At the control circuit 16, in accordance with an instruction from the microcomputer of the control circuit 16, an internal A/D converter is connected to the internal multiplexer. The charging voltage of the main capacitor 11 is converted by the A/D converter from an analog value into a digital value (corresponding to the voltage). The digital value thus obtained is stored within the microcomputer. Then, the microcomputer makes a check to find if the charging voltage measured is at such a predetermined level as to enable the flash discharge tube 12 to emit flash light (charging level required for flash photography) and thus indicates completion of a charging process. If so, the flow of operation proceeds from the step S2 to a step S6. If not, the flow proceeds to a step S3.

At the step S3, the level of the signal CGCOM from the control circuit 16 is shifted from "LL" to "HL" so as to start a voltage step-up action. Accordingly, the input of the logic circuit 5 becomes "HL".

Figure 3:
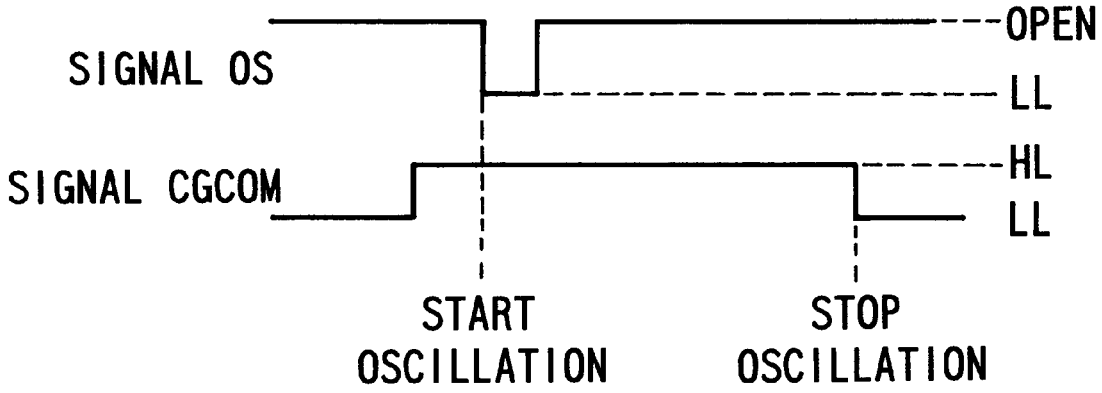
FIG. 3 is a timing chart showing the operation of the flash apparatus shown in FIG. 1.

At a step S4, the one-shot pulse signal is outputted from the terminal OS of the control circuit 16, as shown in FIG. 3, so that the step-up circuit is activated to start oscillation.

At a step S5, with the one-shot pulse signal outputted from the control circuit 16, the base current of the PNP transistor 61 of the current-to-voltage conversion circuit 6 is pulled. With the base current of the PNP transistor 61 pulled, the PNP transistor 61 is turned on, so that a current flows from the emitter of the PNP transistor 61 connected to the Vcc voltage terminal to the collector thereof, thereby generating a voltage at both ends of the resistor 64. This causes both the inputs of the logic circuit 5 to become "HL". Therefore, the output of the logic circuit 5 becomes "HL".

As a result, the FET 4 is turned on. Then, the current of the battery 1 flows between the drain and the source of the FET 4 through the terminals 3*a* and 3*b* of the primary winding of the oscillation transformer 3. Accordingly, an electromotive force is generated on the primary winding side of the transformer 3. Therefore, a voltage proportional to the turn ratio of the transformer 3 is generated on the secondary winding side of the transformer and, at the same time, a base current of the PNP transistor 61 the base of which is connected to the terminal 3*d* of the secondary winding of the transformer 3 is pulled.

With the base current of the PNP transistor 61 pulled, the voltage Vcc of the constant voltage circuit 15 causes a current to be supplied to the terminals 3*d* and 3*c* of the secondary winding of the transformer 3 through the emitter and base of the PNP transistor 61. Then, the current is supplied to the main capacitor 11 through the high-voltage rectifier diode 10.

In the process where the current is increasing in the above manner, magnetic saturation takes place at the transformer 3, thereby causing a sudden attenuation of the current. As a result, the base current of the PNP transistor 61 ceases to be pulled any longer. A current which is proportional to the attenuation of the base current then flows between the emitter and collector of the PNP transistor 61. In addition, the voltage is lowered by the resistor 64 (to effect voltage-to-current conversion). Then, the output of the logic circuit 5 becomes "LL". Therefore, the FET 4 is turned off to cut off the supply of power from the battery 1 to the terminal 3*a* of the primary winding of the oscillation transformer 3.

However, since the current on the secondary winding side of the oscillation transformer 3 is making attenuated oscillation, the voltage at both ends of the resistor 64 of the current-to-voltage conversion circuit 6 rises again. Then, the levels of two inputs of the logic circuit 5 both become "HL" to cause the level of the output of the logic circuit 5 to be at "HL". This causes the FET 4 to turn on. With the FET 4 turned on, the current from the battery 1 flows between the drain and the source of the FET 4 through the terminals 3*a* and 3*b* of the primary winding of the oscillation transformer 3. Then, an electromotive force is generated at the primary winding (terminals 3*a* and 3*b*) of the transformer 3 to repeat oscillation. With the oscillation repeated, electric charge is accumulated at the main capacitor 11, so that the voltage of the main capacitor 11 rises.

At this time, the turning-on of the FET 4 causes a sudden drop of the voltage of the battery 1. When the voltage of the battery 1 becomes lower than the voltage Vref of the input of the comparator 93, the state of the comparator 93 changes from an open state to an "LL" state to cause the output signal CGCOM of the control circuit 16 to become "LL". As a result, one of the inputs of the logic circuit 5 becomes "LL" to make the output of the logic circuit 5 "LL". The "LL" output of the logic circuit 5 causes the FET 4 to turn off to bring the oscillation to a stop.

With the oscillation stopped, the voltage of the battery 1 ceases to drop and comes to recover. With voltage of the battery 1 thus coming to recover, when the voltage of the battery 1 exceeds the voltage Vref of the input of the comparator 93, the output of the comparator 93 changes from the "LL" state to the open state. Accordingly, the input of the logic circuit 5 becomes "HL" to bring the output of the logic circuit 5 to "HL" again. Therefore, the FET 4 is turned on to resume oscillation. The voltage of the power supply is thus prevented from becoming less than a predetermined voltage by repeating the actions in above manner.

As has been described above, turning-on and turning-off of the FET 4, which is employed as an oscillation control switching element, are controlled by the level of voltage obtained through the current-to-voltage conversion, and the process of charging the main capacitor 11 is controlled through the turning-on/off control over the FET 4. Unlike the prior art arrangement described in the foregoing, the step-up circuit according to the first embodiment thus stably operates without depending on the current-amplification factor of the oscillation transistor and without a feedback winding.

Further, at the same time, the output voltage maintaining circuit 9 acts to maintain the output voltage Vcc of the constant voltage circuit 15 as mentioned above. Therefore, the output of the logic circuit 5, which uses the voltage Vcc as a power source, becomes stable. A gate driving voltage for the FET 4 thus also can be maintained. Further, since the voltage Vcc is also a power source for the control circuit 16, the control circuit 16 is prevented from being reset or becoming unstable. The flow then returns from the step S5 to the step S2.

If the level of the charging voltage is found at the step S2 to be sufficient for flash light emission, the flow proceeds to the step S6. At the step S6, the signal CGCOM of the control circuit 16 is changed from "HL" to "LL" so as to bring the voltage step-up action to a stop. Accordingly, the output of the logic circuit 5 is forcibly set to "LL" through the resistor 7. The FET 4 is, therefore, turned off to cut off the supply of power from the battery 1 to the terminal 3*a* of the primary winding of the oscillation transformer 3, so that the oscillation comes to a stop.

At a step S7, a check is made for the state of a switch which is arranged to turn on when a release switch is pushed to a full extent. If the switch is found to be in an off-state, the flow returns to the step S2. If the switch is found to be in an on-state, the flow proceeds to a step S8.

At the step S8, a shutter circuit (not shown) and a diaphragm circuit (not shown) are respectively operated to obtain a shutter speed and an aperture value which are decided according to light measurement data.

At the next step S9, a pulse signal (signal TRG) is outputted from the trigger terminal of the control circuit 16.

At a step S10, when the signal TRG is applied to the trigger circuit 13 while the flash discharge tube 12 is under a high voltage with the main capacitor 11 being charged with a voltage sufficient for flash light emission, a high-voltage pulse is outputted from the trigger circuit 13 to trigger the flash discharge tube 12. The flash discharge tube 12 then emits flash light. Thus, a sequence of flash emitting actions comes to an end.

Incidentally, the output voltage maintaining circuit 9, which is arranged to maintain the output voltage (voltage Vcc) of the constant voltage circuit 15, may be disposed either outside of the control circuit 16, as in the case of the first embodiment, or inside of an analog circuit of the one-chip microcomputer or inside of the control circuit 16.

Further, the first embodiment is arranged to prevent any erroneous oscillating action due to the sensitive response of the comparator 93, by arranging the capacitor 92 to have hysteresis. However, this arrangement may be changed to obtain the hysteresis from a similar reference voltage by making the circuit arrangement different from the above-described circuit arrangement.

(Second Embodiment)

Figure 4:
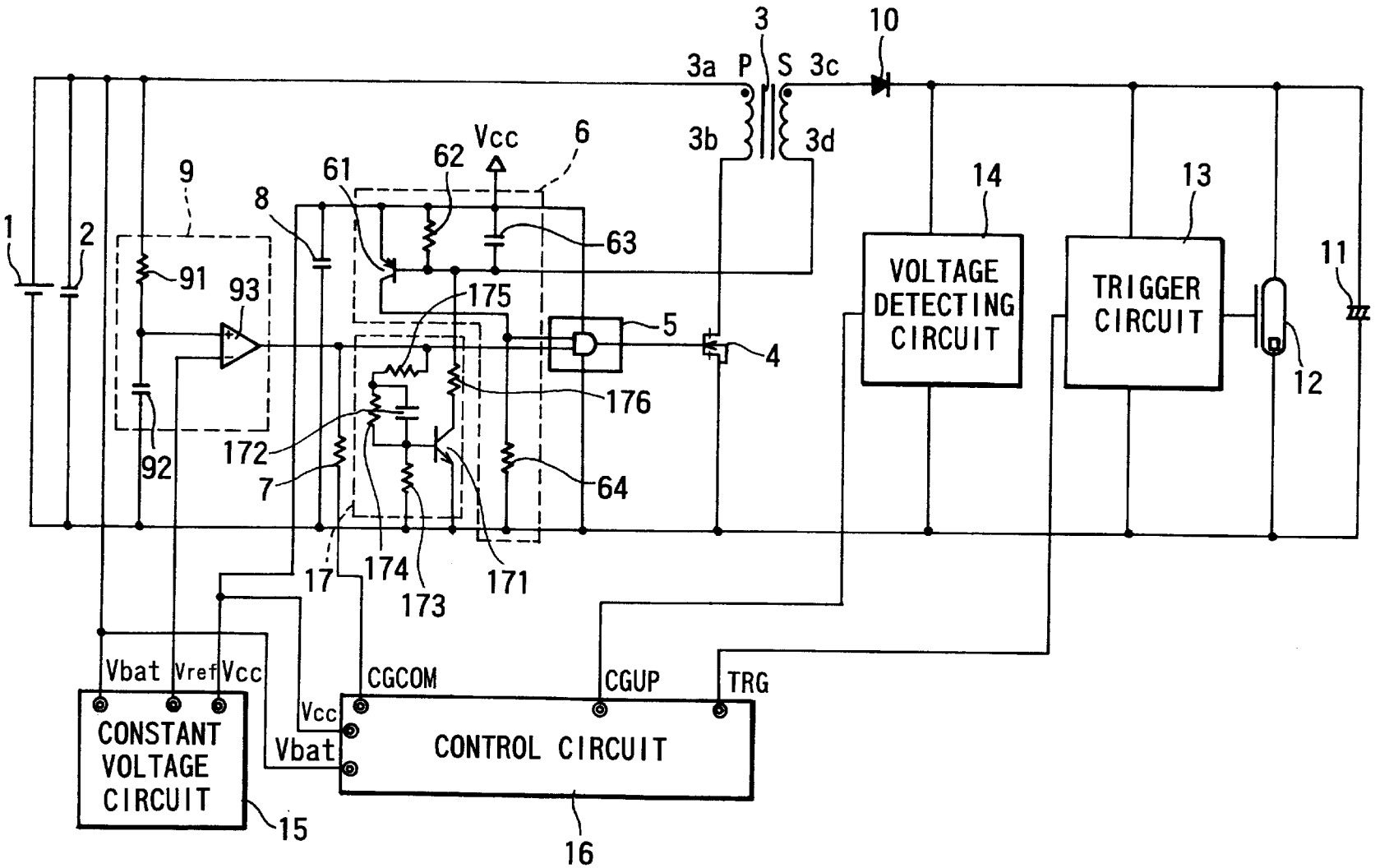
FIG. 4 is a circuit block diagram of a flash apparatus according to a second embodiment of the invention.

FIG. 4 shows the circuit arrangement of a flash apparatus according to a second embodiment of the invention. While the first embodiment performs a one-shot pulse generating action by the control circuit 16, the second embodiment is arranged to perform the one-shot pulse generating action by means of an external circuit and thus obviates the necessity of a signal line for the signal OS of the control circuit 16. In FIG. 4 and in the following description, the same compotent elements as those of the first embodiment are indicated by the same reference numerals and the details of them are omitted from description.

Referring to FIG. 4, reference numeral 17 denotes a one-shot circuit (pulse generating means) which is composed of elements 171 to 176.

The element 171 is an NPN transistor. The collector of the NPN transistor 171 is connected to the base of the PNP transistor 61 through a resistor 176. The emitter of the NPN transistor 171 is connected to the negative electrode of the battery 1. The base of the NPN transistor 171 is connected to one end of a resistor 173, to one end of a resistor 174 and also to one end of a capacitor 172.

The capacitor 172 is provided for forming the one-shot pulse. One end of the capacitor 172 is connected to the base of the NPN transistor 171 and the other end thereof is connected to one end of a resistor 175.

The resistor 173 is connected between the base and emitter of the NPN transistor 171. One end of the resistor 173 is connected to the base of the NPN transistor 171 and the other end thereof is connected to the negative electrode of the battery 1.

The resistor 174 has its one end connected to the base of the NPN transistor 171 and the other end connected to the other end of the capacitor 172. The resistor 174 is thus connected to both ends of the capacitor 172. The resistor 175 has its one end connected to the capacitor 172 and the other end connected to the input of the logic circuit 5. The element 176 is a resistor 176, which has its one end connected to the collector of the NPN transistor 171 and the other end connected to the base of the PNP transistor 61.

When the level of the signal CGCOM rises from "LL" to "HL", the control circuit 16 causes the base of the NPN transistor 171 to be at "HL" through the resistor 7, for a period of time determined by the time constants of the capacitor 172 and the resistors 173, 174 and 175, to pull the base current of the PNP transistor 61, thereby activating the step-up circuit. After this action, the control circuit 16 operates in about the same manner as the operation of the control circuit 16 in the first embodiment, with the exception of the step S4.

At the step S4, the control circuit 16 sends a signal to the one-shot circuit 17 through the resistor 7. When the signal CGCOM rises from "LL" to "HL", a current flows for a moment to the capacitor 172 through the resistor 175 and further to the base of the NPN transistor 171 to turn on the NPN transistor 171 just for a moment. The momentary turning-on of the NPN transistor 171 causes the base current of the PNP transistor 61 to be pulled through the resistor 176.

(Third Embodiment)

Figure 5:
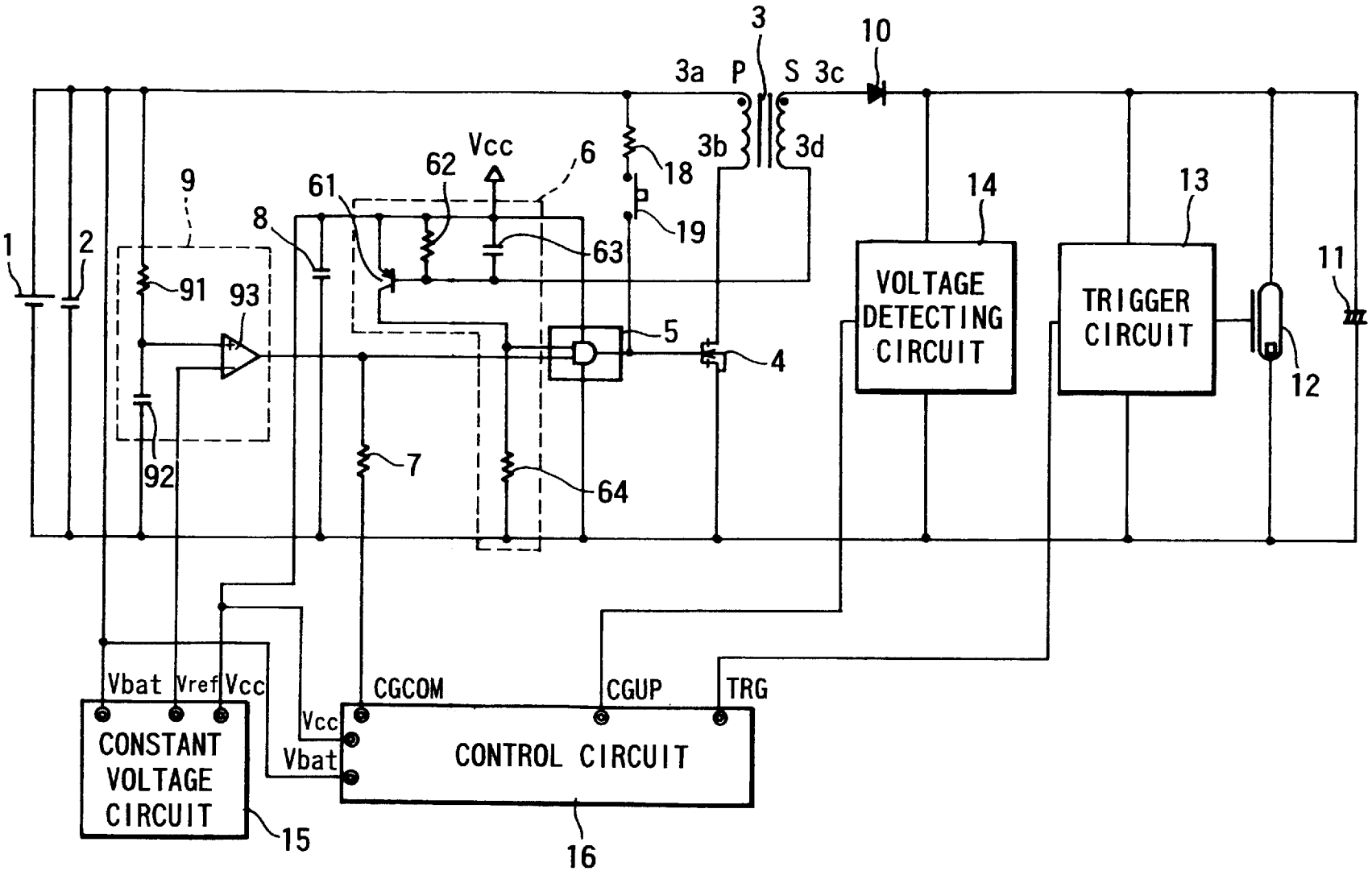
FIG. 5 is a circuit block diagram of a flash apparatus according to a third embodiment of the invention.
Figure 6:
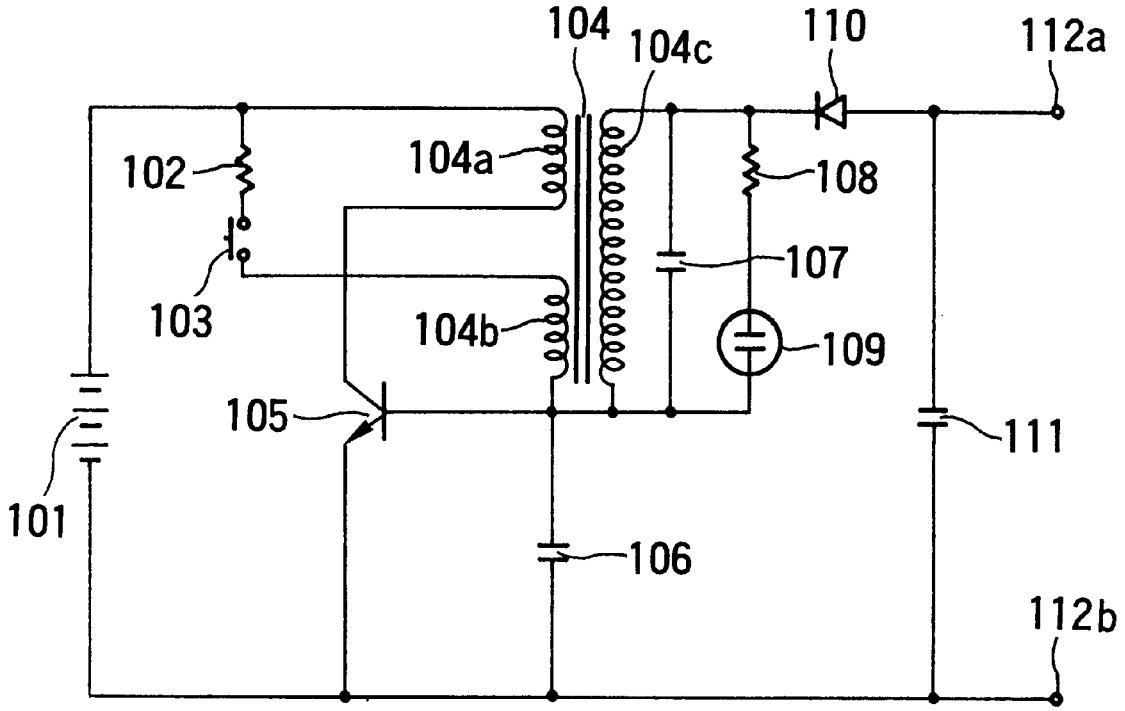
FIG. 6 (PRIOR ART)
FIG. 6 is a circuit block diagram of a conventional power supply device.

FIG. 5 shows the circuit arrangement of a flash apparatus according to a third embodiment of the invention. The third embodiment is arranged to simplify the first embodiment by omitting the one-shot pulse output from the terminal OS of the control circuit 16 of the first embodiment. In FIG. 5 and in the following description, all parts of the third embodiment that are the same as those of the first embodiment are indicated by the same reference numerals and the details of them are omitted from description.

Referring to FIG. 5, a resistor 18 has its one end connected to the positive electrode of the battery 1. A switch 19 has its one end connected to the other end of the resistor 18. The other end of the switch 19 is connected to the gate of the FET 4. The switch 19 is arranged to promptly turn off upon completion of its turning-on action and is, for example, in the form of a push switch. The switch 19 may be a semiconductor switch.

The third embodiment operates in the same manner as the first embodiment, except the step S4. At the step S4, when the switch 19 is pushed after the level of the signal CGCOM rises from "LL" to "HL", the control circuit 16 directly causes the gate of the FET 4 to turn on to allow the current of the battery 1 to flow between the drain and source of the FET 4 through the primary winding (terminals 3*a* and 3*b*) of the oscillation transformer 3. Accordingly, an electromotive force is generated on the primary winding side of the oscillation transformer 3, and a voltage proportional to the turn ratio of the oscillation transformer 3 is generated on the secondary winding side thereof. Then, the base current of the PNP transistor 61 which is connected to the terminal 3*d* of the secondary winding of the oscillation transformer 3 is pulled.

Accordingly, a current is supplied to the main capacitor 11 from the constant voltage circuit 15 through the emitter and base of the PNP transistor 61, the secondary winding (terminals 3*d* and 3*c*) of the transformer 3 and the high-voltage rectifier diode 10.

In each of the embodiments described above, the CMOS logic circuit is employed as the active element. However, the cmos logic circuit may be replaced with a cmos buffer.

What is claimed is:

1. A flash apparatus comprising:

a transformer;

a switching element connected in series to a primary coil of said transformer, said switching element being turned on to cause a current from a power supply to flow to the primary coil and being turned off to cut off the current to the primary coil;

current-to-voltage conversion means connected to a secondary coil of said transformer for forming a voltage according to a value of a current flowing to the secondary coil; and a signal forming circuit which detects the voltage formed by said current-to-voltage conversion means and shifts an output state thereof from a first signal output state to a second signal output state when having detected that the voltage indicates a voltage value representing that the value of the current flowing to the secondary coil is less than a predetermined value, wherein said switching element is connected to said signal forming circuit and is arranged to be turned on when the output state of said signal forming circuit is the first signal output state and to be turned off when the output state of said signal forming circuit is the second signal output state.

2. A flash apparatus according to claim 1, wherein said signal forming circuit is composed of an active element.

3. A flash apparatus according to claim 1, wherein said signal forming circuit is a CMOS logic circuit.

4. A flash apparatus according to claim 1, wherein said switching element is a field-effect transistor.

5. A flash apparatus according to claim 1, wherein said signal forming circuit has an operating voltage supplied thereto at a constant voltage from a constant voltage circuit.

6. A flash apparatus comprising:

a transformer;

a switching element connected in series to a primary coil of said transformer, said switching element being turned on to cause a current from a power supply to flow to the primary coil and being turned off to cut off the current to the primary coil;

a current-to-voltage conversion circuit having a transistor and an impedance element, a base of said transistor being connected to a secondary coil of said transformer so that a base current according to a value of a current flowing to the secondary coil flows, a collector of said transistor being connected to said impedance element, said transistor forming, as an output of said impedance element, a voltage according to the value of the current flowing to the secondary coil; and a signal forming circuit which detects the voltage formed by said current-to-voltage conversion circuit and shifts an output state thereof from a first signal output state to a second signal output state when having detected that the voltage indicates a voltage value representing that the value of the current flowing to the secondary coil is less than a predetermined value, wherein said switching element is connected to said signal forming circuit and is arranged to be turned on when the output state of said signal forming circuit is the first signal output state and to be turned off when the output state of said signal forming circuit is the second signal output state.

7. A flash apparatus according to claim 6, wherein said signal forming circuit is composed of an active element.

8. A flash apparatus according to claim 6, wherein said signal forming circuit is a CMOS logic circuit.

9. A flash apparatus according to claim 6, wherein said switching element is a field-effect transistor.

10. A flash apparatus according to claim 6, wherein said signal forming circuit has an operating voltage supplied thereto at a constant voltage from a constant voltage circuit.

11. A flash apparatus according to claim 6, further comprising a start-up circuit which causes a base current to flow to the base of said transistor during start-up of said flash apparatus.

12. A flash apparatus according to claim 6, further comprising a start-up circuit which supplies a signal to turn on said switching element during start-up of said flash apparatus.

13. A DC-to-DC converter device for a flash apparatus, comprising:

a transformer;

a switching element connected in series to a primary coil of said transformer, said switching element being turned on to cause a current from a power supply to flow to the primary coil and being turned off to cut off the current to the primary coil;

current-to-voltage conversion means connected to a secondary coil of said transformer for forming a voltage according to a value of a current flowing to the secondary coil; and a signal forming circuit which detects the voltage formed by said current-to-voltage conversion means and shifts an output state thereof from a first signal output state to a second signal output state when having detected that the voltage indicates a voltage value representing that the value of the current flowing to the secondary coil is less than a predetermined value, wherein said switching element is connected to said signal forming circuit and is arranged to be turned on when the output state of said signal forming circuit is the first signal output state and to be turned off when the output state of said signal forming circuit is the second signal output state.

14. A DC-to-DC converter device according to claim 13, wherein said signal forming circuit is composed of an active element.

15. A DC-to-DC converter device according to claim 13, wherein said signal forming circuit is a CMOS logic circuit.

16. A DC-to-DC converter device according to claim 13, wherein said switching element is a field-effect transistor.

17. A DC-to-DC converter device according to claim 13, wherein said signal forming circuit has an operating voltage supplied thereto at a constant voltage from a constant voltage circuit.

18. A DC-to-DC converter device for a flash apparatus, comprising:

a transformer;

a switching element connected in series to a primary coil of said transformer, said switching element being turned on to cause a current from a power supply to flow to the primary coil and being turned off to cut off the current to the primary coil;

a current-to-voltage conversion circuit having a transistor and an impedance element, a base of said transistor being connected to a secondary coil of said transformer so that a base current according to a value of a current flowing to the secondary coil flows, a collector of said transistor being connected to said impedance element, said transistor forming, as an output of said impedance element, a voltage according to the value of the current flowing to the secondary coil; and a signal forming circuit which detects the voltage formed by said current-to-voltage conversion circuit and shifts an output state thereof from a first signal output state to a second signal output state when having detected that the voltage indicates a voltage value representing that the value of the current flowing to the secondary coil is less than a predetermined value, wherein said switching element is connected to said signal forming circuit and is arranged to be turned on when the output state of said signal forming circuit is the first signal output state and to be turned off when the output state of said signal forming circuit is the second signal output state.

19. A DC-to-DC converter device according to claim 18, wherein said signal forming circuit is composed an active element.

20. A DC-to-DC converter device according to claim 18, wherein said signal forming circuit is a CMOS logic circuit.

21. A DC-to-DC converter device according to claim 18, wherein said switching element is a field-effect transistor.

22. A DC-to-DC converter device according to claim 18, wherein said signal forming circuit has an operating voltage supplied thereto at a constant voltage from a constant voltage circuit.

23. A DC-to-DC converter device according to claim 18, further comprising a start-up circuit which causes a base current to flow to the base of said transistor during start-up of said flash apparatus.

24. A DC-to-DC converter device according to claim 18, further comprising a start-up circuit which supplies a signal to turn on said switching element during start-up of said flash apparatus.

* * * * *

UNITED STATES PATENT AND TRADEMARK OFFICE

CERTIFICATE OF CORRECTION

PATENT NO. : 6,147,460
DATED : November 14, 2000
INVENTOR(S) : Yoshiro Ichihara

It is certified that error appears in the above-identified patent and that said Letters Patent is hereby corrected as shown below:

Column 9,
Line 34, delete "compotent" and insert -- component --.

Column 10,
Line 57, delete "cmos logic" and insert -- CMOS logic -- and delete "cmos buffer" and insert -- CMOS buffer --.

Signed and Sealed this

First Day of January, 2002

*Attest:*

*Attesting Officer*

JAMES E. ROGAN
*Director of the United States Patent and Trademark Office*